United States Patent [19]

Skinner

[11] Patent Number: 4,480,964

[45] Date of Patent: Nov. 6, 1984

[54] REFRIGERANT COMPRESSOR LUBRICATION SYSTEM

[75] Inventor: Timothy J. Skinner, Spring Valley, Ohio

[73] Assignee: General Motors Corporation, Detroit, Mich.

[21] Appl. No.: 526,676

[22] Filed: Aug. 26, 1983

Related U.S. Application Data

[63] Continuation-in-part of Ser. No. 352,087, Feb. 25, 1982, abandoned.

[51] Int. Cl.[3] ..... F04B 1/26; F04B 1/16; F04B 1/18; F25B 1/02

[52] U.S. Cl. ..... 417/222; 417/270; 62/226

[58] Field of Search ..... 417/222, 270; 62/226

[56] References Cited

U.S. PATENT DOCUMENTS

| | | | |
|---|---|---|---|
| 3,861,829 | 1/1975 | Roberts | 417/270 |
| 3,959,983 | 1/1976 | Roberts | 62/226 |
| 4,061,443 | 12/1977 | Black | 417/222 |
| 4,073,663 | 2/1978 | Abendschein | 417/222 |
| 4,145,163 | 3/1979 | Fogelberg | 417/222 |
| 4,174,191 | 11/1979 | Roberts | 417/222 |
| 4,342,547 | 8/1982 | Yamada | 418/87 |

*Primary Examiner*—William L. Freeh
*Attorney, Agent, or Firm*—R. L. Phillips

[57] ABSTRACT

There is disclosed in a refrigerant compressor whose crankcase is vented to compressor suction, a passive lubrication system having a lubrication-vent path arrangement which vents the crankcase while also assuring lubrication of the compressor's critical bearing surfaces using oil entrained in the refrigerant and wherein centrifugal action is utilized to always maintain some amount of oil in the crankcase for assured lubrication of the critical bearing surfaces under all operating conditions while also minimizing the amount of oil permitted to circulate in the refrigerant circuit for improved air conditioning performance.

4 Claims, 4 Drawing Figures

REFRIGERANT COMPRESSOR LUBRICATION SYSTEM

This application is a continuation-in-part of my copending application Ser. No. 352,087, filed Feb. 25, 1982, now abandoned.

This invention relates to refrigerant compressor lubrication systems and more particularly to passive type lubrication systems for refrigerant compressors with swash or wobble plate drive mechanisms using oil entrained in the refrigerant to lubricate the mechanism's critical bearing surfaces.

Lubrication systems for refrigerant compressors with wobble or swash plate drive mechanisms have advanced from using splash and/or pressurized oil circulation such as by a pump to a simpler less-costly passive type system using oil entrained in the refrigerant to lubricate the compressor's critical rotating bearing surfaces, i.e. those of the wobble or swash plate. However, the conventional passive type lubrication system normally relies on the compressor mechanism being located in a crankcase which may be formed as part of the compressor's refrigerant circuit, i.e. the compressor's suction or discharge refrigerant passages. Thus, the conventional passive type lubrication system is not normally adaptable to compressors of the type wherein refrigerant gas pressure is developed in the crankcase and must be vented to the compressor suction circuit to maintain optimum compressor performance and/or as a matter of crankcase pressure control to control compressor displacement.

According to the present invention, the venting of the crankcase in the latter type of compressor is advantageously utilized to provide adequate lubrication of the compressor mechanism's critical bearings surfaces under all operating conditions and in a simple low-cost passive manner not requiring an oil pump or some other form of pressurized oil supply. The present invention is disclosed in its preferred form in a variable displacement axial piston refrigerant compressor whose displacement is varied automatically according to demand by controlling the refrigerant gas pressure differential between the crankcase and compressor suction with a demand responsive valve which operates to bleed or vent the crankcase to suction to effect the desired displacement control. According to the present invention, the crankcase-suction vent is formed with bleed or vent passage means connecting the crankcase to compressor suction between the critical bearing surfaces of the compressor drive mechanism to lubricate same by entrained lubricant in the gaseous refrigerant while also causing some of the entrained lubricant to be separated by centrifugal action at the bearing surfaces and returned to the crankcase for further compressor lubrication usage. As a result, the amount of lubricant actually delivered to the compressor suction and available for circulation in the refrigerant circuit served by the compressor is substantially reduced so that an amount of lubricant returned to the crankcase by such centrifugal action may be retained therein and always available for such further compressor's lubrication.

These and other objects, advantages and features of the present invention will become more apparent from the following description and drawing in which.

Figure 1:
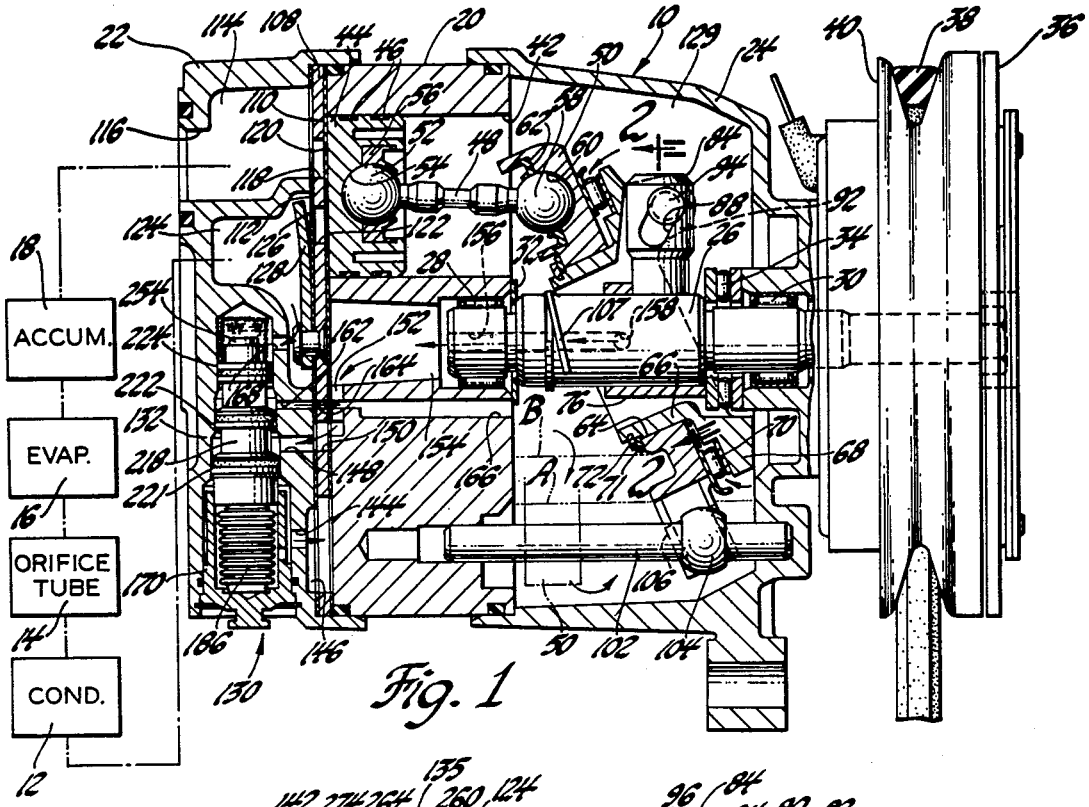
FIG. 1 is a cross-sectional view of a variable displacement refrigerant compressor of the variable angle wobble plate type having incorporated therein the preferred embodiment of the passive lubrication system according to the present invention. This figure further includes a schematic of an automotive air conditioning system in which the compressor is connected.

Referring to FIG. 1, there is shown a variable displacement refrigerant compressor 10 of the variable angle wobble plate type connected in an automotive air conditioning system having the normal condenser 12, orifice tube 14, evaporator 16 and accumulator 18 arranged in that order between the compressor's discharge and suction sides. The compressor 10 comprises a cylinder block 20 having a head 22 and a crankcase 24 sealingly clamped to opposite ends thereof. A drive shaft 26 is supported centrally in the compressor at the cylinder block 20 and crankcase 24 by radial needle bearings 28 and 30, respectively, and is axially retained by a thrust washer 32 inward of the needle bearing 28 and a thrust needle bearing 34 inward of the radial needle bearing 30. The drive shaft 26 extends through the crankcase 24 for connection to an automotive engine (not shown) by an electromagnetic clutch 36 which is mounted on the crankcase and is driven from the engine by a belt 38 engaging a pulley 40 on the clutch.

The cylinder block 20 has five axial cylinders 42 extending therethrough (only one being shown), which are equally angularly spaced about and equally radially spaced from the axis of drive shaft 26. The cylinders 42 extend parallel to the drive shaft 26 and a piston 44 having seals 46 is mounted for reciprocal sliding movement in each of the cylinders. A separate piston rod 48 connects the backside of each piston 44 to a non-rotary ring-shaped wobble plate 50 received about the drive shaft 26. Each of the piston rods 48 is connected to its respective piston 44 by a spherical rod end 52 which is retained in a socket 54 on the backside of the piston by a retainer 56 that is swaged in place. The opposite end of each piston rod 48 is connected to the wobble plate 50 by a similar spherical rod end 58 which is retained in a socket 60 on the wobble plate by a split retainer ring 62 which has a snap fit with the wobble plate.

Figure 2:
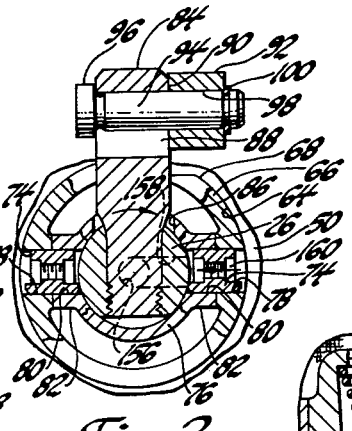
FIG. 2 is an enlarged cross-sectional view taken generally along the line 2—2 in FIG. 1.

The non-rotary wobble plate 50 is mounted at its inner diameter 64 on a journal 66 of a rotary drive plate 68 and is axially retained thereon against a thrust needle bearing 70 by a thrust washer 71 and snap ring 72. As shown in FIG. 2, the drive plate 68 is pivotally connected at its journal 66 by a pair of pivot pins 74 to a sleeve 76 which is slidably mounted on the drive shaft 26, the pins being mounted in aligned bores 78 and 80 in opposite sides of the journal 66 and radially outwardly extending bosses 82 on the sleeve 76 respectively with the common axis of the pivot pins intersecting at right angles with the axis of the drive shaft 16 to permit angulation of the drive plate 68 and wobble plate 50 relative to the drive shaft.

The drive shaft 26 is drivingly connected to the drive plate 68 by a lug 84 which extends freely through a longitudinal slot 86 in the sleeve 76. The drive lug 84 is threadably connected at one end to the drive shaft 26 at right angles thereto and extends radially outward past the journal 66 where it is provided with a guide slot 88 for guiding the angulation of the drive plate 68 and wobble plate 50. The drive lug 84 has flat-sided engagement on one side thereof at 90 with an ear 92 formed integral with the drive plate 68 and is retained thereagainst by a cross pin 94 which is at right angles to the drive shaft and is slidable in and guided by the guide slot 88 as the sleeve 76 moves along the drive shaft 26. The cross pin 94 is retained in place on the drive plate 68 at its ear 92 by being provided with an enlarged head 96 at one end which engages the lug at one side of the slot 88 and being received adjacent the other end in a cross-hole 98 in the drive plate ear 92 where it is retained by a snap ring 100. The wobble plate 50 while being angularable with the rotary drive plate 68 is prevented from rotating therewith by a guide pin 102 on which a ball guide 104 is slidably mounted and retained on the wobble plate. The guide pin 102 is press-fitted at opposite ends in the cylinder block 20 and crankcase 24 parallel to the drive shaft 26 and the ball guide 104 is retained between semi-cylindrical guide shoes 106 (only one being shown) which are slidably mounted for reciprocal radial movement in the wobble plate 50.

The drive lug arrangement for the drive plate 68 and the anti-rotation guide arrangement for the wobble plate 50 are like that disclosed in greater detail in U.S. Pat. Nos. 4,175,915 and 4,297,085 respectively assigned to the assignee of this invention and which are hereby incorporated by reference. With such arrangements, there is provided essentially constant top-dead-center positions for each of the pistons 44 by the pin follower 94 which is movable radially with respect to the drive lug 84 along its guide slot or cam track 88 as the sleeve 76 moves along the drive shaft 26 while the latter is driving the drive plate 68 through the drive lug 84 and drive plate ear 92 in the direction indicated by the arrow in FIG. 2. As a result, the angle of the wobble plate 50 is varied with respect to the axis of the drive shaft 26 between the solid line large angle position shown in FIG. 1 which is full-stroke to the zero angle phantom-line position shown which is zero stroke to thereby infinitely vary the stroke of the pistons and thus the displacement or capacity of the compressor between these extremes. As shown in FIG. 1, there is provided a split ring return spring 107 which is mounted in a groove on the drive shaft 26 and has one end that is engaged by the sleeve 76 during movement to the zero wobble angle position and is thereby conditioned to initiate return movement.

The working ends of the cylinders 42 are covered by a valve plate 108 which together with an intake or suction valve disk 110 and an exhaust or discharge valve disk 112 located on opposite sides thereof are clamped to the cylinder block 20 between the latter and the head 22. The head 22 is provided with a suction cavity or chamber 114 which is connected through an external port 116 to receive gaseous refrigerant from the accumulator 18 downstream of the evaporator 16. The suction cavity 114 is open to an intake port 118 in the valve plate 108 at the working end of each of the cylinders 42 where the refrigerant is admitted to the respective cylinders on their suction stroke each through a reed valve 120 formed integral with the suction valve disk 110 at these locations. Then on the compression stroke, a discharge port 122 open to the working end of each cylinder 42 allows the compressed refrigerant to be discharged into a discharge cavity or chamber 124 in the head 22 by a discharge reed valve 126 which is formed integral with the discharge valve disk 112 at these locations, the extent of opening of each of the discharge reed valves being limited by a rigid back-up strap 128 which is riveted at one end to the valve plate 108. The compressor's discharge cavity 124 is connected to deliver the compressed gaseous refrigerant to the condenser 12 from whence it is delivered through the orifice tube 14 back to the evaporator 16 to complete the refrigerant circuit as shown in FIG. 1.

The wobble plate angle and thus compressor displacement is controlled by controlling the refrigerant gas pressure in the sealed interior 129 of the crankcase behind the pistons 44 relative to the suction pressure. In this type of control, the angle of the wobble plate is determined by a force balance on the pistons wherein a slight elevation of the crankcase-suction pressure differential above a set suction pressure control point creates a net force on the pistons that results in a turning moment about the wobble plate pivot pins 74 that acts to reduce the wobble plate angle and thereby reduce the compressor capacity. For such control one practice is to employ a control valve which is automatically actuated by a bellows or diaphragm biased by compressor suction pressure and operates when the air conditioning capacity demand is high and the resulting suction pressure rises above the control point so as to maintain a bleed or vent from crankcase to suction so that there is no crankcase-suction pressure differential. As a result, the wobble plate 50 will then angle to its full stroke large angle position shown in FIG. 1 establishing maximum displacement. On the other hand, when the air conditioning capacity demand is lowered and the suction pressure falls to the control point, the control valve with its suction pressure bias then operates to close off the crankcase vent connection with suction and either provide communication between the compressor discharge and the crankcase or allow the pressure therein to increase as a result of gas blow-by past the pistons. This has the effect of increasing the crankcase-suction pressure differential which on slight elevation creates a net force on the pistons that results in a turning moment about the wobble plate pivot pins 74 that reduces the wobble plate angle and thereby reduces the compressor displacement. But another more advanced control practice is to use the variable displacement control valve arrangement generally designated as 130 which is responsive to compressor discharge pressure as well as suction pressure to automatically control the compressor displacement or capacity according to demand. In the latter control valve arrangement as in the former, there is venting of the crankcase to compressor suction to control the crankcase pressure and thereby the compressor displacement and such venting is utilized by the present invention to provide adequate lubrication of the compressor's critical bearing surfaces under all operating conditions and in a simple low-cost passive manner not requiring an oil pump or some other form of pressurized oil supply.

Figure 3:
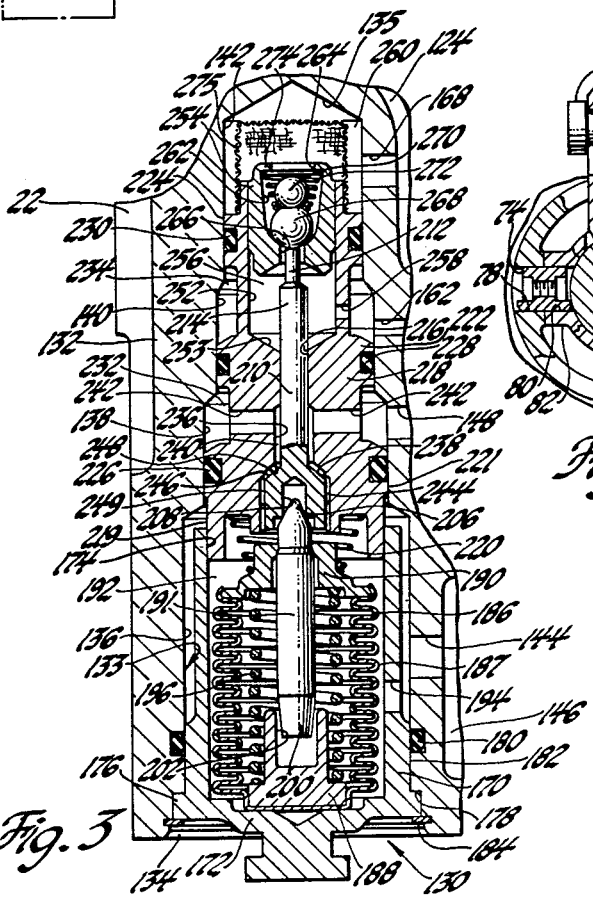
FIG. 3 is an enlarged cross-sectional view of the control valve arrangement in FIG. 1.

The preferred embodiment of the passive lubrication system of the present invention is shown incorporated in the advanced control valve arrangement 130 and to understand the improved lubrication system it is helpful to also fully understand this control valving and its operation. As shown in FIGS. 1 and 3, the control valve arrangement 130 comprises a valve housing 132 which in the preferred embodiment is formed integrally in the head 22 and has a stepped blind bore 133 having an open external end 134 through the periphery of the head 22 and a closed internal end 135 with stepped and progressively smaller bore portions designated 136, 138, 140 and 142. The intermost and largest diameter bore portion 136 is open through a radial port 144 and a passage 146 in the head 22 to the suction cavity 114 which is also in the compressor's head. The present invention is incorporated in the control valve arrangement by connecting the adjacent and smaller diameter bore portion 138 to the interior 129 of the crankcase through lubrication-vent passage means formed by a radial port 148 in the head 22, a port 150 in the valve plate 108, passageways 152 and 154 in the cylinder block 20, a central axial passage 156 and intersecting radial passage 158 in the drive shaft 26, a central axial passage 160 in one of the drive plate pivot pins 74 and along the drive plate journal 66 past the wobble plate 50 and through its thrust needle bearing 70 (see FIGS. 2 and 3). As will be described in more detail later, the crankcase vent path thus provided apart from its crankcase pressure control function effects by such routing assured lubrication of the wobble plate mechanism's critical rotating bearing surfaces. Referring meantime back to the valve, the adjacent and smaller diameter bore portion 140 of the valve housing is also connected to the interior 129 of the crankcase 24 but in a direct route through a radial port 162 in head 22, a port 164 in valve plate 108 and a passage 166 in the cylinder block 20. The adjacent and smallest diameter bore portion 142 at the closed end 136 of the stepped valve body bore is directly open to the discharge cavity 124 through a radial port 168 in the head.

A cup-shaped valve bellows cover 170 having a closed outer end 172 and an open inner end 174 is sealingly inserted in a fixed position in the open end 134 of the housing's stepped bore 133 at the large diameter bore portion 136 with the positioning thereof determined by a cylindrical flange 176 on the cover engaging a shoulder 178 at the stepped outer end of the large diameter bore portion 136 as best seen in FIG. 3. Sealing thereof is provided by an O-ring 180 which is received in an internal groove in the large bore portion 136 and sealingly contacts with a cylindrical land 182 of the bellows cover 170. Retention of the bellows cover 170 is provided by a snap ring 184 which is received in an interior groove in the bore end 134 and engages the outer side of the bellows cover flange 176. Thus, the bellows cover 170 has its closed end 172 positioned in and closing the open end 134 of the valve housing 132 and its open end 174 facing inward toward the closed end 135 of the valve housing.

An evacuated bellows 186 is concentrically located within the bellows cover 170 and is seated against the latter's closed end 172. The bellows 186 has a cup-shaped corrugated thin-wall metal casing 187 which at its closed and seated end receives a spring seat member 188. The other end of the bellows casing 187 is sealingly closed by an end member 190 through which an output rod 191 centrally extends and is sealingly fixed thereto. The bellows 186 is evacuated so as to expand and contract in response to pressure changes within a surrounding annular pressure control cell 192 which is formed by the exterior of the bellows and the interior of the bellows cover 170 and is continuously open through a radial port 194 in the bellows cover 170 to the suction pressure communicating port 144 of the control valve housing 132. A compression coil spring 196 is located in the bellows and extends between the bellow's two rigid end members 188 and 190. The thus captured spring 196 normally maintains the bellows in an extended position producing an outward force on the output rod 191. The output rod 191 is tapered at its inner end 200 for guided movement in a blind bore 202 in the interior seat member 188 on contraction of the bellows. The exterior and opposite end 206 of the output rod 191 is pointed and seats in a coupling pocket 208 of an actuating valve pin member 210. The actuating valve pin member 210 at its opposite end is formed with a reduced valve needle or stem portion 212 and is sealingly slidably supported for reciprocal movement along an intermediate constant diameter portion or length 214 thereof in a central axial bore 216 formed in a stepped spool-shaped cylindrical valve body 218 mounted in the valve housing bore 133 inward of the bellows 186.

The valve body 218 is formed with a cylindrical land 219 which is press-fitted in the open end 174 of the bellows cover 170, this land extending sufficiently within the open end of the valve bellows cover to provide an axially adjustable sealed juncture which is operable to provide calibration of the bellows unit. Moreover, a conical compression coil spring 220 is concentrically positioned intermediate the bellows end member 190 and the outer end of the valve body 218 and acts to hold the bellows 186 in seating engagement with the bellows cover 170. With such arrangement, the pointed exterior end 206 of the bellows force output rod 191 automatically aligns and couples with the valve pin pocket 208 in the actuating valve pin member 210 whereby the bellows output rod and the actuating valve pin member are conditioned to move axially in unison.

The central valve body 218 is sealingly received and positioned in the respective progressively smaller diameter bore portions 138, 140 and 142 by progressively smaller diameter land portions 221, 222 and 224 formed on the valve body which each have an O-ring seal 226, 228 and 230 respectively received in an annular groove therein and sealingly engaging the respective valve body bore portions. The O-ring 226 at the large diameter land portion 221 thus seals off the bellows pressure control cell 192 which is open to suction pressure and also cooperates with the O-ring seal 228 at the adjacent smaller diameter valve body land 222 to seal off an annular chamber 232 at the bore portion 138 which is indirectly open through the port 148 to the crankcase through the vent passage provided by the present invention. The O-ring seal 228 also cooperates with the O-ring seal 230 at the adjacent smaller diameter valve body land 224 to seal off an annular chamber 234 extending about the spool valve body at the bore portion 140 which is directly open to the crankcase through the port 162. The valve body O-ring seal 230 also seals off the closed end 136 of the valve body bore which is directly open at its smallest diameter bore portion 142 through the port 168 to the discharge cavity 124.

Figure 4:
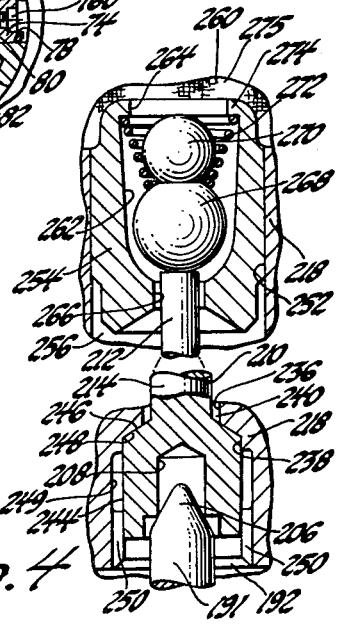
FIG. 4 is an enlarged view of portions of the control valve arrangement in FIG. 3.

The central bore 216 through the midportion of the valve body 218 joins at its end nearest the bellows with a counterbore 236 which in turn joins with a larger counterbore 238 that is open to the bellows pressure control cell 192 and thus to compressor suction. The counterbore 236 forms an annular crankcase bleed or vent valve passage 240 which extends about the actuating valve pin member portion 214 and is connected by a pair of diametrically aligned radial ports 242 to the chamber 232 and thus to the crankcase. The larger diameter counterbore 238 is open to the crankcase vent valve passage 240 and slidably supports an enlarged cylindrical head portion 244 formed on the actuating valve pin member 210 at the bellows end thereof. The enlarged valve pin member head portion 244 operates to control crankcase venting and is provided for that purpose with a tapered step 246 where it joins with the long cylindrical pin portion 214. The tapered step 246 provides a valve face which is engageable with a conical valve seat 248 forming the step between the valve body counterbores 236 and 238 to close the crankcase vent valve passage 240 as shown in FIG. 4 and described in more detail later. Alternatively, the valve face 246 is movable off the valve seat 248 to first open the crankcase vent valve passage 240 to the counterbore 238 and thence upon slight further movement the valve head 244 uncovers an annular groove 249 in the counterbore 238. The groove 249 is open to a pair of longitudinally extending passages 250 also in the counterbore 238 which upon such valve movement are then effective to connect the crankcase vent valve passage 240 with the bellows pressure control cell 192 and thus with the compressor suction cavity 114.

The central bore 216 in the valve body 218 joins at its opposite end with a larger diameter valve body bore 252 which is closed at one end by a tapered step 253 extending from the actuator valve pin member portion 214 and receives at its other end a crankcase charge valve body member 254. The crankcase charge valve body member 254 is press-fitted in the valve body bore 252 to form on one side thereof and within the valve body a cavity 256 which extends about the actuator valve pin member portion 214 and is open through a radial port 258 in the valve body to the outwardly located chamber 234 and thus to the crankcase. The crankcase charge valve body member 254 also cooperates with the small diameter valve body portion 224 and its O-ring seal 230 to form with the closed end 135 of the valve housing bore a chamber 260 which is open through the radial port 168 in the valve housing to the compressor discharge cavity 124.

The crankcase charge valve body member 254 is formed with a bell-shaped valve cavity 262 which is exposed through an open end 264 to the discharge pressure connected chamber 260 and is openable at the other end to a central crankcase charge valve port 266 that receives the smaller diameter stem portion 212 of the actuating valve pin member 210 and opens to the chamber 256 communicating with the crankcase. Mounted in the crankcase charge valve body member 254 in the cavity 262 is crankcase charge valving comprising a large ball segment 268 and a small ball segment 270 which are welded together and are biased by a conical coil compression spring 272 so that the large ball segment 268 is held against the end of actuating valve pin member stem portion 212 and normally seats on the complementary shaped portion of the bell-shaped cavity 262 to close the crankcase charge valve port 266. The spring 272 is seated at its opposite and enlarged end on a spunover annular edge 274 of the valve body member 254 which defines the opening 264 to the valve cavity and there being mounted thereover a screen 275 to filter out foreign matter. The conical spring's smaller end has a slightly smaller diameter than the smaller ball segment 270 allowing this spring end to be snap fastened for capture between the large and small ball segments. This facilitates the universal movement of the unitary ball valve element 268, 270 with respect to the spring 272 so that the large ball valve element 268 will mate with its valve seat sufficiently to insure their sealing relation when the valve is in its closed postion shown in FIG. 3 and so that the ball valve element 268 will remain in alignment during valve opening movement to its full open position shown in FIG. 4 in which condition the refrigerant gas at discharge pressure is allowed to flow through the crankcase charge valve port past the actuating valve pin member stem portion 212 to the crankcase.

In addition to the spring biasing force acting to close the valve element 268 on the crankcase charge valve port 266 and also simultaneously open the crankcase vent valve port 240 by acting through the valve elements 268, 270 on the actuating valve pin member 210 to effect the open position of its vent valve end 244, there is effected a gas discharge pressure bias achieved by the discharge pressure in cavity 260 acting on the unbalanced upstream side of the movable crankcase charge valve segments 268, 270. This discharge pressure bias at the crankcase charging end of the control valve arrangement is used to depress the compressor's displacement control point with increasing discharge pressure in addition to the discharge pressure being made available through the opening of the crankcase charge valve port 266 by the controlling charge valve elements 268, 270 to charge the crankcase to achieve decreased compressor displacement as described in more detail later.

The large ball valve segment 268 is caused to move off its valve seat and open the crankcase charge valve port 266 against the force of spring 272 and the variable discharge pressure bias by expansion of the suction pressure and spring biased bellows 186 acting through the actuating valve pin member 210 which at the same time acts at its valve head 244 to close the crankcase bleed valve port 240. On the other hand, these crankcase charge and crankcase vent valve operations are reversed by contraction of the suction pressure biased bellows 186 assisted by the discharge pressure bias at the crankcase charge valve 268.

Describing now the operation of the variable displacement compressor control valve arrangement 130 in the system, gaseous refrigerant leaving the accumulator 18 at low pressure enters the compressor's suction cavity 114 and is discharged to the compressor's discharge cavity 124 and thence to the condenser 12 at a certain rate dependent on the compressor's wobble plate angle. At the same time, the gaseous refrigerant at suction pressure is transmitted at the compressor to the bellows cell 192 to act on the evacuated bellows 186 which tends to expand in response to a decrease in the suction pressure thus acting thereon to provide a force on the bellows output rod 191 which urges movement of the actuating valve pin member 210 toward the position shown in FIG. 4 closing the crankcase vent valve port 240 and simultaneously opening the crankcase charge valve port 266. On the other hand, the gaseous refrigerant discharge pressure at the compressor is at the same time transmitted to the valve chamber 260 to act on the ball valve arrangement 268, 270 in opposition to bellows expansion to urge closing of the crankcase charge valve port 266 and simultaneous opening of the crankcase vent valve port 240 as shown in FIG. 3. These variable pressure biases are in addition to the spring biases which act to normally condition the control valve arrangement 130 so as to close the crankcase charge valve port 266 and simultaneously open the crankcase vent valve port 240 to thereby normally effect maximum compressor displacement by establishing zero crankcase-suction pressure differential. The objective is to match the compressor displacement with the air conditioning demand under all conditions so that the evaporator 16 is kept just above the freezing temperature (pressure) without cycling the compressor on and off with the clutch 36 and with the optimum being to maintain as cold an evaporator as can be achieved at higher ambients without evaporator freeze and at lower ambients, as high an evaporator temperature as can be maintained while still supplying some de-humidification. To this end, the control point for the control valve arrangement 130 determining displacement change is selected so that when the air conditioning capacity demand is high, the suction pressure at the compressor after the pressure drop from the evaporator 16 will be above the control point (e.g. 170–210 kPa). The control valve arrangement 130 is calibrated at assembly at the bellows 186 and with the spring biases so that the then existing discharge-suction pressure differential acting on the control valve arrangement is sufficiently high to maintain same in the condition shown in FIG. 3 closing the crankcase charge valve port 266 and opening the crankcase vent valve port 240. The control valve arrangement 130 will then maintain a bleed or vent from the crankcase to suction while simultaneously closing off discharge pressure thereto so that no crankcase-suction pressure differential is developed and as a result, the wobble plate 50 will remain in its maximum angle position shown in solid line in FIG. 1 to provide maximum compressor displacement. Then when the air conditioning capacity demand reduces and the suction pressure reaches the control point, the resulting change in the discharge-suction pressure differential acting on the control valve arrangement 130 will condition its valving to then open the crankcase charge valve port 266 and simultaneously close the crankcase bleed port 240 and thereby elevate the crankcase-suction pressure differential. The angle of the wobble plate 50 is controlled by a force balance on the pistons 44 so only a slight elevation (e.g. 40–100 kPa) of the crankcase-suction pressure is effective to create a net force on the pistons that results in a moment about the wobble plate pivot axis that reduces the wobble plate angle and thereby the compressor displacement. Moreover, in that the control valve bellows 186 in addition to being acted on by the suction control pressure has to also overcome discharge pressure in expanding to elevate the crankcase-suction pressure differential to reduce compressor displacement, the displacement change control point is thus depressed with increasing discharge pressure (higher ambients). In that the refrigerant flow rate, and in turn suction line pressure drop, increases with increasing discharge pressure (higher ambients) the control valve will depress the control point proportional to the discharge pressure and likewise suction line pressure drop. This compressor displacement compensating feature permits controlling at the compressor suction while maintaining a nearly constant evaporator pressure (temperature) above freezing which has been found to result in substantially better high load performance and reduced power consumption at low ambients on a yearly basis.

In the above type of compressor as in some other reciprocating piston type compressors and engines with crankcase-to-suction venting but without the lubrication-venting arrangement of the present invention, most if not all the oil that is added to the crankcase for lubrication will become entrained in the gas therein and be discharged from the cylinders because of the venting to suction. On the other hand, some of the oil that is discharged is returned to the crankcase via the piston rings scraping the cylinder walls and/or the operating pressure differential blowing the oil past the piston rings. For example, it is known in prior art constructions that at full stroke (displacement) and consequently maximum pressure differential, and dependent on both how effective are the piston rings or seals and how fast the compressor is running, there may or may not be blowby past the pistons which with the entrained oil provides adequate lubrication of the wobble plate mechanism. Preferably, both of the seals (46) on each of the pistons are of the type and are mounted on the pistons according to the disclosure in U.S. Pat. No. 4,351,227 in which event there is very tight double sealing to prevent significant blowby but at the sacrifice of the lubrication of the wobble plate mechanism thereby. But in any event, at partial stroke (displacement) there is less pressure differential for forcing any blowby for such lubrication. According to the present invention, the lubrication-vent passage means formed by the ports and passages 148, 150, 152, 154, 156, 158 and 160 route the venting of the crankcase 24 to the compressor's suction cavity 114 through the rotating bearing surfaces of the wobble plate 50, i.e. those at the thrust needle bearing 70 and at the journal 66 which supports the wobble plate at its inner diameter 64. The arrows shown in FIGS. 1 and 2 depict the circulation of the refrigerant within the compressor wherein the entrained oil is also made available to lubricate the drive shaft's two radial needle bearings 28 and 30 and the rubbing or sliding surfaces of the variable angle wobble plate mechanism in the crankcase. The venting path thus provided forces the pressurized gaseous refrigerant with the oil entrained therein to flow radially inwardly through the wobble plate's anti-friction bearing, i.e. the thrust needle bearing 70, and also along or through the drive plate journal 66 at the inner diameter 64 of the wobble plate 50 to reach the vent passage 160 to the compressor's suction cavity 114 in the wobble plate pivot at the one pivot pin thus assuring lubrication of these critical rotating bearing surfaces. Moreover, the entrained oil is caused to separate by centrifugal action at these rotating bearing surfaces and be returned to the crankcase for further compressor lubrication usage. As a result, the amount of oil actually delivered with such venting to the compressor suction cavity and available for discharge from the compressor at the discharge cavity to the refrigerant circuit is substantially reduced so that some amount of the oil returned to the crankcase by the centrifugal action is retained therein and always available for further lubrication of the compressor mechanism and particularly its critical bearing surfaces. This assures that under all compressor operating conditions and particularly reduced stroke, some amount of oil will be retained in the crankcase for lubrication of the mechanism's critical bearing surfaces. In the compressor disclosed, it was found that when the oil retained in the crankcase exceeds about $\frac{3}{4}$ ounces, there is a build-up of free oil that provides splash lubrication of the wobble plate mechanism. With the present invention it was found that at partial or reduced stroke (displacement) when there is minimum blowby there was retained a more than adequate amount of oil for splash lubrication ranging from $\frac{1}{2}$–3 ounces with the oil observed at approximately the level A shown in FIG. 1 when the clutch was cycled off. On the other hand, at full stroke (displacement) it was found that an even greater amount of oil ranging from $2\frac{1}{2}$–5 ounces was retained with the oil being observed to reach approximately the level B shown in FIG. 1 when the clutch was cycled off. Moreover, the amount of oil thus permitted to circulate in the refrigeration system external to the compressor is minimized which results in a substantial improvement in air conditioning performance.

The above described preferred embodiment is illustrative of the invention which may be modified within the scope of the appended claims.

The embodiments of the invention in which an exclusive property or privilege is claimed are defined as follows:

1. In a variable displacement refrigerant compressor having a crankcase containing the compressor's operating mechanism, compression chambers each with a suction valve for admitting gaseous refrigerant with entrained lubricant thereto from a suction cavity and a discharge valve for delivering the refrigerant therefrom to a discharge cavity, and a displacement control valve means responsive to at least suction pressure that operates on at least a vent passage between the compressor's crankcase and the suction cavity so as to control the crankcase pressure relative to the suction pressure to thereby control the compressor displacement: the improvement comprising lubrication-vent passage means in said vent passage for venting the crankcase pressure to the suction cavity between rotating bearing surfaces of the compressor's operating mechanism to thereby lubricate the bearing surfaces by entrained lubricant while also causing some of the entrained lubricant to be separated by centrifugal action at said bearing surfaces and returned to the crankcase for further compressor lubricant usage and whereby the amount of lubricant actually delivered to the compressor suction cavity from the crankcase and available for discharge from the compressor at the discharge cavity is substantially reduced so that some amount of lubricant returned to the crankcase by said centrifugal action is retained therein and always available for such further compressor lubrication.

2. In a variable displacement refrigerant compressor of the variable angle wobble plate type having a crankcase containing a drive plate and a wobble plate that is supported on the drive plate by a thrust bearing and a journal bearing, compression chambers each with a suction valve for admitting gaseous refrigerant with entrained lubricant thereto from a suction cavity and a discharge valve for delivering the refrigerant therefrom to a discharge cavity, and a displacement control valve means responsive to at least suction pressure that operates on at least a vent passage between the compressor's crankcase and the suction cavity so as to control the crankcase pressure relative to the suction pressure to thereby control the compressor displacement: the improvement comprising lubrication-vent passage means in said vent passage for venting the crankcase pressure to the suction cavity through the bearings to thereby lubricate the bearings by entrained lubricant while also causing some of the entrained lubricant to be separated by centrifugal action at the bearings and returned to the crankcase for further compressor lubricant usage and whereby the amount of lubricant actually delivered to the compressor suction cavity from the crankcase and available for discharge from the compressor at the discharge cavity is substantially reduced so that some amount of lubricant returned to the crankcase by said centrifugal action is retained therein and always available for such further compressor lubrication.

3. In a variable displacement refrigerant compressor of the variable angle wobble plate type having a crankcase containing a drive plate supported by and pivotal about a pair of pivot pins and a wobble plate supported on the drive plate by a thrust bearing and a journal bearing, compression chambers each with a suction valve for admitting gaseous refrigerant with entrained lubricant thereto from a suction cavity and a discharge valve for delivering the refrigerant therefrom to a discharge cavity, and a displacement control valve means responsive to at least suction pressure that operates on at least a vent passage between the compressor's crankcase and the suction cavity so as to control the crankcase pressure relative to the suction pressure to thereby control the compressor displacement: the improvement comprising lubrication-vent passage means in said vent passage for venting the crankcase pressure to the suction cavity through the bearings and via a passage in one of the pivot pins to thereby lubricate the bearings by entrained lubricant while also causing some of the entrained lubricant to be separated by centrifugal action at the bearings and returned to the crankcase for further compressor lubricant usage and whereby the amount of lubricant actually delivered to the compressor suction cavity and available for discharge from the compressor at the discharge cavity is substantially reduced so that some amount of lubricant returned to the crankcase by said centrifugal action is retained therein and always available for such further compressor lubrication.

4. In a variable displacement refrigerant compressor having a crankcase containing the compressor's operating mechanism, compression chambers each with a suction valve for admitting gaseous refrigerant with entrained lubricant thereto from a suction cavity and a discharge valve for delivering the refrigerant therefrom to a discharge cavity, and a displacement control valve means responsive to at least suction pressure that operates on at least a vent passage between the compressor's crankcase and the suction cavity so as to control the crankcase pressure relative to the suction pressure to thereby control the compressor displacement: the improvement comprising lubrication-vent passage means in said vent passage for venting the crankcase pressure to the suction cavity between rotating bearing surfaces of the compressor's operating mechanism to thereby lubricate the bearing surfaces by entrained lubricant while also causing some of the entrained lubricant to be separated by centrifugal action at said bearing surfaces and returned to the crankcase for further compressor lubricant usage and whereby the amount of lubricant actually delivered to the compressor suction cavity from the crankcase and available for discharge from the compressor at the discharge cavity is substantially reduced so that some amount of lubricant returned to the crankcase by said centrifugal action is retained therein sufficient to maintain splash lubrication of the compressor's operating mechanism at partial displacement.

* * * * *